US009222191B2

(12) United States Patent
Wong

(10) Patent No.: US 9,222,191 B2
(45) Date of Patent: Dec. 29, 2015

(54) LAMINAR FLOW PLATING RACK

(75) Inventor: Samuel Kah Hean Wong, Johor (MY)

(73) Assignee: Seagate Technology LLC, Cupertino, CA (US)

( * ) Notice: Subject to any disclaimer, the term of this patent is extended or adjusted under 35 U.S.C. 154(b) by 450 days.

(21) Appl. No.: 13/278,068

(22) Filed: Oct. 20, 2011

(65) Prior Publication Data

US 2012/0100287 A1 Apr. 26, 2012

Related U.S. Application Data

(60) Provisional application No. 61/405,116, filed on Oct. 20, 2010.

(51) Int. Cl.

| | |
|---|---|
| ***B05C 3/02*** | (2006.01) |
| ***B05C 11/00*** | (2006.01) |
| ***B05D 5/12*** | (2006.01) |
| ***C25D 17/00*** | (2006.01) |
| ***B05C 3/10*** | (2006.01) |
| ***B05C 3/109*** | (2006.01) |
| ***C25D 5/08*** | (2006.01) |
| ***C25D 17/08*** | (2006.01) |
| ***C25D 21/10*** | (2006.01) |

(52) U.S. Cl.

CPC ..... *C25D 17/008* (2013.01); *B05C 3/10* (2013.01); *B05C 3/109* (2013.01); *C25D 5/08* (2013.01); *C25D 17/08* (2013.01); *C25D 21/10* (2013.01)

(58) Field of Classification Search

None

See application file for complete search history.

(56) References Cited

U.S. PATENT DOCUMENTS

| | | | | |
|---|---|---|---|---|
| 4,581,260 | A * | 4/1986 | Mawla | 427/443.1 |
| 5,755,935 | A * | 5/1998 | Jackson et al. | 204/202 |
| 7,498,062 | B2 | 3/2009 | Calcaterra et al. | |
| 7,758,732 | B1 | 7/2010 | Calcaterra et al. | |
| 2005/0263401 | A1 * | 12/2005 | Olsen et al. | 205/143 |
| 2007/0023277 | A1 * | 2/2007 | Mizohata et al. | 204/212 |
| 2007/0080057 | A1 * | 4/2007 | Mizohata et al. | 204/198 |

* cited by examiner

*Primary Examiner* — Dah-Wei D Yuan
*Assistant Examiner* — Jethro M Pence

(57) ABSTRACT

A plating apparatus includes a vessel and a rack operable to be positioned inside the vessel. The rack includes a number of mandrels including a number of substrate mounting surfaces. The number of mandrels is non-revolving with respect to the rack. The rack further includes a number of gears coupled with the number of mandrels. A partition separates the number of gears from the number of mandrels. A diffuser is positioned below the rack. The diffuser is operable to produce a substantially uniform laminar flow of a fluid from a bottom to a top of the vessel. Thus, the laminar flow may reduce dead zones in the bath and remove defect-causing particles and gases away from the substrate.

20 Claims, 6 Drawing Sheets

LAMINAR FLOW PLATING RACK

PRIORITY CLAIM

The present patent application claims benefit to U.S. provisional patent application Ser. No. 61/405,116, filed on Oct. 20, 2010, entitled "Non-Revolving NIP Plating Rack with Laminar Flow,", inventor: S. Wong, which application is hereby incorporated by reference in its entirety herein.

FIELD

Embodiments according to the present invention generally relate to plating equipment.

BACKGROUND

During the process of plating substrates, for example magnetic storage disks used in hard disk drives, substrates may be exposed to a bath including a plating fluid. While the substrates are submerged in the bath, the plating fluid may react with the surfaces of the substrates, resulting in plated substrates. Some plating processes may include the use of a pump to move the plating fluid into a vessel that holds the bath. Filters may be used to filter out particles or gas bubbles.

Some factors may affect the plating process, including the substrate exposure time, the movement of the plating fluid, and the amount/concentration of defect-causing particles or gas bubbles within the bath. For example, the bath may contain plastics introduced by the grinding of gears or the rubbing of retaining bars against the substrates. The gas bubbles or particles may cause substrate plating defects, e.g. substrate pits, substrate bumps, inclusion pits, etc.

The substrates may be mounted on racks including mandrels or rods that may move the substrates in and out of the bath. Each mandrel may rotate so that the substrates mounted on the mandrels also rotate within the bath. At the same time, multiple mandrels may be positioned to form a carousel that rotates within the bath. However, the motion of the carousel disrupts the flow pattern of the plating fluid, which can inhibit uniform plating of the substrates.

In addition, the disruption of the flow pattern by the carousel may create vortexes in the bath. The vortexes may form dead zones where the particles and gas bubbles are trapped rather than captured and removed by the filters. As a result, the amount particles and gas bubbles within the bath may increase, causing additional plating defects.

BRIEF DESCRIPTION OF THE DRAWINGS

Embodiments of the present invention are illustrated by way of example, and not by way of limitation, in the figures of the accompanying drawings.

DETAILED DESCRIPTION

Reference will now be made in detail to embodiments, examples of which are illustrated in the accompanying drawings. While the embodiments will be described in conjunction with the drawings, it will be understood that they are not intended to limit the embodiments. On the contrary, the embodiments are intended to cover alternatives, modifications and equivalents. Furthermore, in the following detailed description, numerous specific details are set forth in order to provide a thorough understanding. However, it will be recognized by one of ordinary skill in the art that the embodiments may be practiced without these specific details. In other instances, well-known methods, procedures, components, and circuits have not been described in detail as not to unnecessarily obscure aspects of the embodiments.

For expository purposes, the term "horizontal" as used herein refers to a plane parallel to the plane or surface of a substrate, regardless of its orientation. The term "vertical" refers to a direction perpendicular to the horizontal as just defined. Terms such as "above," "below," "bottom," "top," "side," "higher," "lower," "upper," "over," and "under" are referred to with respect to the horizontal plane.

Embodiments of the present invention provide as described herein methods and systems directed to plating substrates, for example data storage media. However, embodiments of the present invention can be applied to plating any object. In an embodiment, substrates may be mounted on a rack and lowered into a plating bath. The substrates may be mounted on rods within the rack. The rods may be non-revolving, e.g. fixed in position, with respect to each other, and the rods may rotate the mounted substrates. As a result of the fixed position of the rods, a substantially uniform flow of fluid within the plating bath may be established.

In addition, rotating gears may be isolated from the substrates, thus restricting gear contaminants from reaching the substrates. Furthermore, the uniform flow of the fluid may quickly remove the gear contaminants and gas contaminants from the bath, before contaminating the substrates. Thus, embodiments of the present invention may decrease or eliminate defects formed by contaminants on substrates during plating.

Figure 1:
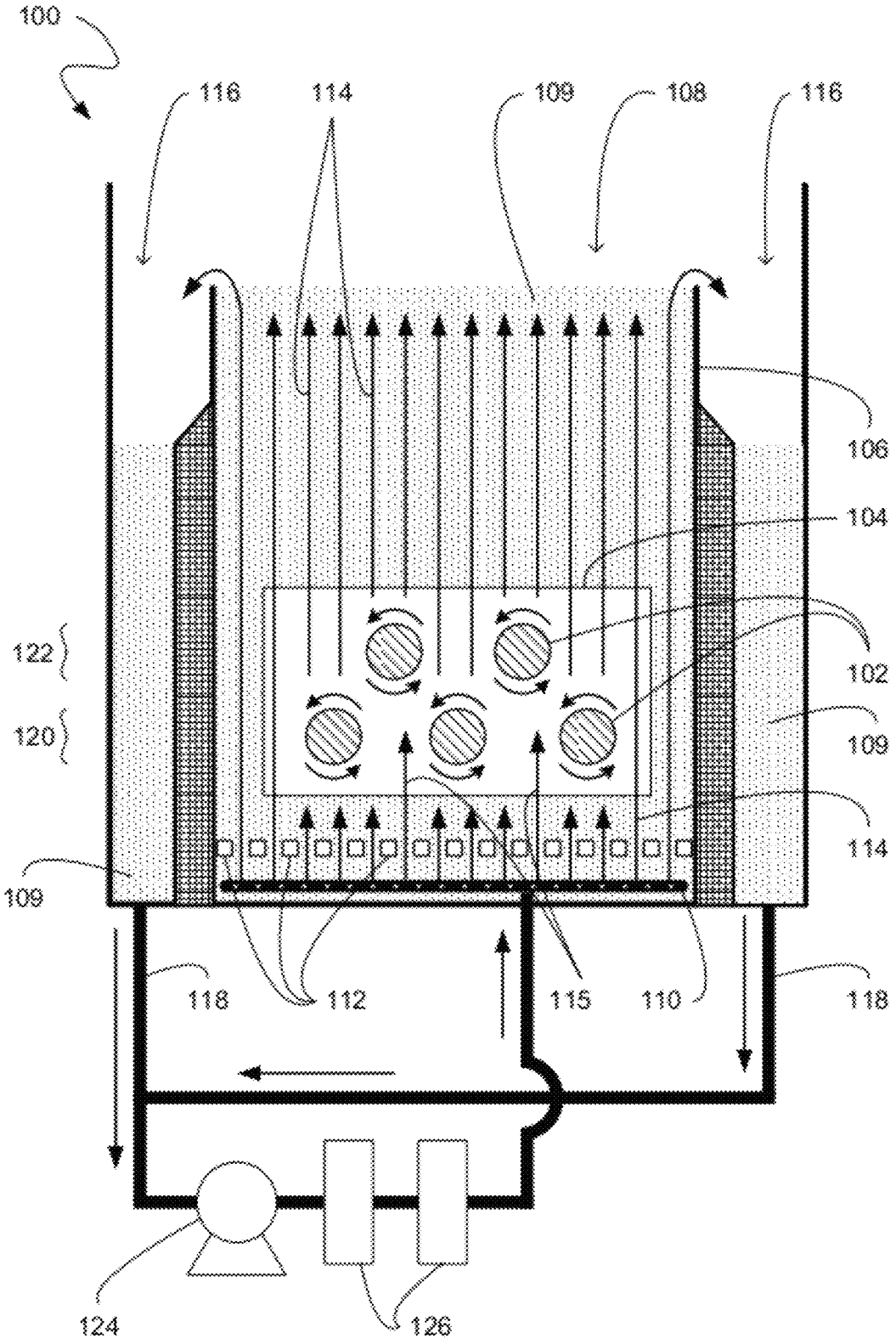
FIG. 1 is a cross section of a plating apparatus, according to an embodiment of the present invention.

FIG. 1 is a cross section of an exemplary plating apparatus 100, according to an embodiment of the present invention. Substrates 102 are maintained by a rack 104 that is positioned inside of a vessel 106. The vessel 106 contains a plating bath 108 that includes a plating fluid 109.

In various embodiments, a sparger 110 may inject the plating fluid 109 into the vessel 106. For example, the sparger 110 may inject the plating fluid 109 from or in the bottom of the vessel 106. The sparger 110 may inject the plating fluid 109 at multiple points, thus distributing the plating fluid 109 uniformly across the bottom of the vessel 106. For example, the sparger 110 may include rows of pipes extending across the bottom of the vessel 106 and perforations allowing for the release of the plating fluid 109 into the vessel 106.

The uniform distribution of the plating fluid 109 reduces the formation of dead zones (not shown) by establishing a uniform flow of the plating fluid from the bottom of the vessel 106 to the top of the vessel 106. Dead zones may be regions of the plating fluid 109 within the vessel 106 that do not follow a predetermined flow pattern, e.g. from the bottom of the vessel 106 to the top of the vessel 106. Dead zones may trap contaminants and/or cause uneven plating of the substrates 102.

In some embodiments, a diffuser 112 may be positioned above the sparger 110 and below the substrates 102. The diffuser 112 may be perforated (not shown), for example with slits or apertures. The perforations may further establish the uniform flow of the plating fluid 109 by causing the plating fluid 109 to flow in uniform and parallel layers. The uniform and parallel flow creates a laminar flow pattern 114 with minimal disruption between the layers.

Thus for example, the plating fluid 109 may be injected into the bottom of the vessel 106 by the sparger 110. The plating fluid 109 passes through the perforations in the diffuser 112. Thus, the diffuser 112 causes the plating fluid 109 to form the laminar flow pattern 114.

Accordingly, the plating fluid 109 may carry particles, e.g. solid and/or gas contaminants, away from the substrates 102 and toward the top of the bath 108. In addition, the plating fluid 109 may uniformly flow across the substrates 102, thus forming uniform plating on the substrates 102. In some embodiments, the rack 104 includes a bottom wall (not shown) with openings to allow the plating fluid 109 to pass through. The bottom wall may act as the diffuser or as an additional diffuser.

After the plating fluid 109 passes across the substrates 102, it eventually reaches the top of the bath 108, pours over the vessel walls, and into weir sections 116. During this process, some or all of the gas bubbles may be removed from the plating fluid 109 and escape into the surrounding environment. The plating fluid 109 may drain from the weir sections 116 through draining channels 118 to a pump 124 and filters 126. The pump 124 causes the plating fluid 109 to move through the weir sections 116, through the filters 126, and to the sparger 110. The filters 126 remove particles from the plating fluid 109 before the plating fluid 109 is injected back into the bath 108.

Figure 2:
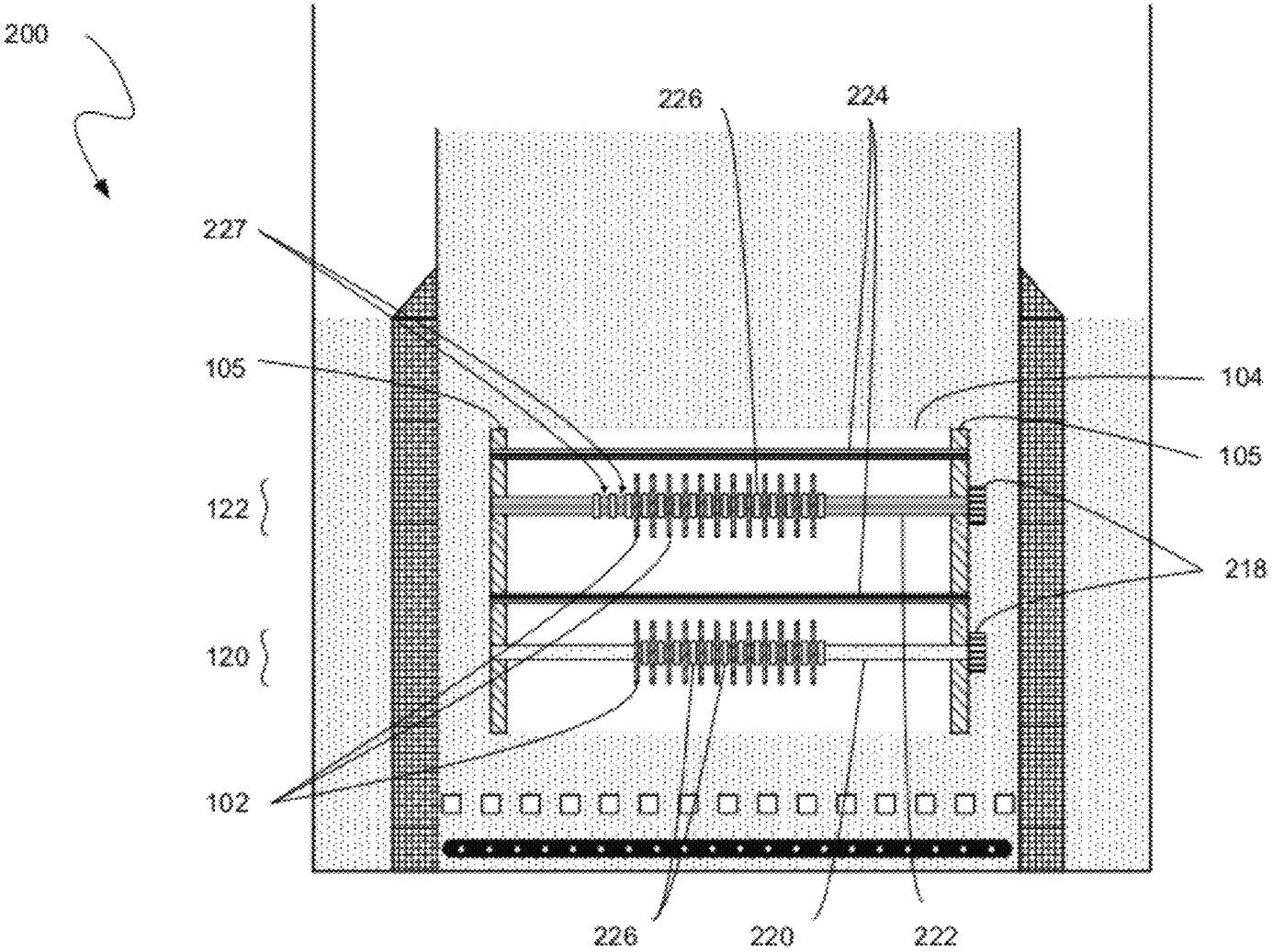
FIG. 2 is a side view of the plating apparatus, according to an embodiment of the present invention.

In some embodiments, the substrates 102 may be mounted on rotatable substrate mounting rods or mandrels that are supported by the rack (see FIG. 2). Accordingly, the substrates 102 may be non-revolving, e.g. fixed in position, with respect to the rack 104 and rotated on the mounting rods. Since the substrates 102 are fixed in position with respect to the rack 104 within the bath 108, the laminar flow pattern 114 of the plating fluid 109 may be minimally disrupted. As a result, the plating fluid 109 may flow across the substrates 102 in a uniform fashion, creating a uniform plating thickness on the substrates 102.

In various embodiments, substrates 102 are mounted in multiple rows at various levels. For example, there may be lower level rows 120 and upper level rows 122 of the substrates 102. In further embodiments, the lower level rows 120 may be offset from the upper level rows 122 such that the substrates 102 are not directly below or above each other.

For example, the lower level rows 120 and the upper level rows 122 may be offset from each other such that the substrates 102 in the lower level rows 120 are positioned between the substrates 102 in the upper level rows 122. As a result, the laminar flow 115 of the plating fluid 109 passing between the lower level rows 120 may be minimally disrupted when it reaches the upper level rows 122. Accordingly, the substrates 102 in both rows may be exposed to a uniform flow of the plating fluid 109.

FIG. 2 is a side view of the plating apparatus 200, according to an embodiment of the present invention. The substrates 102 are maintained by lower substrate mounting rods 220 and upper substrate mounting rods 222. For example, the substrates 102 may be mounted on the lower substrate mounting rods 220 and the upper substrate mounting rods 222 within mounting indentations 227 and/or between spacers 226. The spacers 226 may separate the substrates 102 from one another.

In various embodiments, any number of mounting rods may be positioned in any arrangement relative to one another, e.g. there may be multiple rows of substrate mounting rods. For example, there may be substrate mounting rods above and below the lower substrate mounting rods 220. In addition there may be further substrate mounting rods above and below the upper substrate mounting rods 222.

In some embodiments, the rack 104 may include side walls 105, and the top and bottom of the rack 104 may be open, allowing fluid to flow from the bottom of the rack 104 to the top of the rack 104. Gears 218 may be coupled with the lower substrate mounting rods 220 and the upper substrate mounting rods 222. The gears 218 may be separated from the inside of the rack 104 by the side walls 105. The lower substrate mounting rods 220 and the upper substrate mounting rods 222 may extend through the side walls of the rack 104 so that they may be coupled with the gears 218.

Accordingly, the gears 218 are operable to rotate the lower substrate mounting rods 220 and the upper substrate mounting rods 222, while being isolated from the inside of the rack 104. Thus, the substrates 102 mounted on the lower substrate mounting rods 220 and the upper substrate mounting rods 222 are also isolated from the gears 218. As a result, any particles that are shed by the rubbing between the gears 218 or other mechanical movements will be separated from the substrates 102 by the side walls 105, thus preventing the particles from causing defects.

In some embodiments, the gears 218 may be positioned on one side of the rack 104. However, in other embodiments, the gears 218 may be on both sides of the rack 104. In various embodiments, the gears 218 coupled with the lower substrate mounting rods 220 may be positioned on one side of the rack 104 while the gears 218 coupled with the upper substrate mounting rods 222 may be positioned on the other side of the rack 104.

The movement of the rack during transportation or the flow of the plating fluid 109 during the plating process may displace the substrates 102, on the lower substrate mounting rods 220 and the upper mounting rods 222. Therefore, in some embodiments, retaining bars 224 may be positioned to prevent the substrates 102 from dismounting from the mounting indentations 227, e.g. cross or jump slots. In further embodiments, the spacers 226 may prevent the substrates 102 from contacting one another. For example, one or more of the substrates 102 may encounter dismounting forces created by the flow of the plating fluid 109 or the movement of the rack 104.

To prevent dismounts, the retaining bars 224 may be positioned in parallel to each of the lower substrate mounting rods 220 and the upper substrate mounting rods 222. In some embodiments, the retaining bars 224 may be positioned such that the retaining bars 224 do not come into contact with the substrates 102 when the substrates 102 are mounted in the mounting indentations 227. However, the retaining bars 224 are further positioned to contact one or more of the substrates 102 that become displaced from their mounting position in the mounting indentations 227. Accordingly, the retaining bars 224 will prevent substrates 102 that are becoming displaced from dismounting from the mounting indentations 227. In an embodiment, the retaining bars 224 are positioned equal to or less than 2 mm from the edge of the substrates 102 when the substrates 102 are mounted with the mounting indentations 227.

When one or more of the substrates 102 become displaced and contact one or more of the retaining bars 224, contaminating particles may be shed. For example, if the substrates 102 temporarily jump due to a shock event, the retaining bars 224 will stop the substrates 102, causing the substrates 102 to return their respective mounting indentations 227. In some embodiments, the retaining bars 224 are positioned above the substrates 102. Therefore, any contaminating particles may be created above the substrates 102. Such particles will be carried by the laminar flow pattern 114 (FIG. 1) upward and away from, e.g. not across, the substrates 102, thereby preventing defects caused by such particles.

Figure 3:
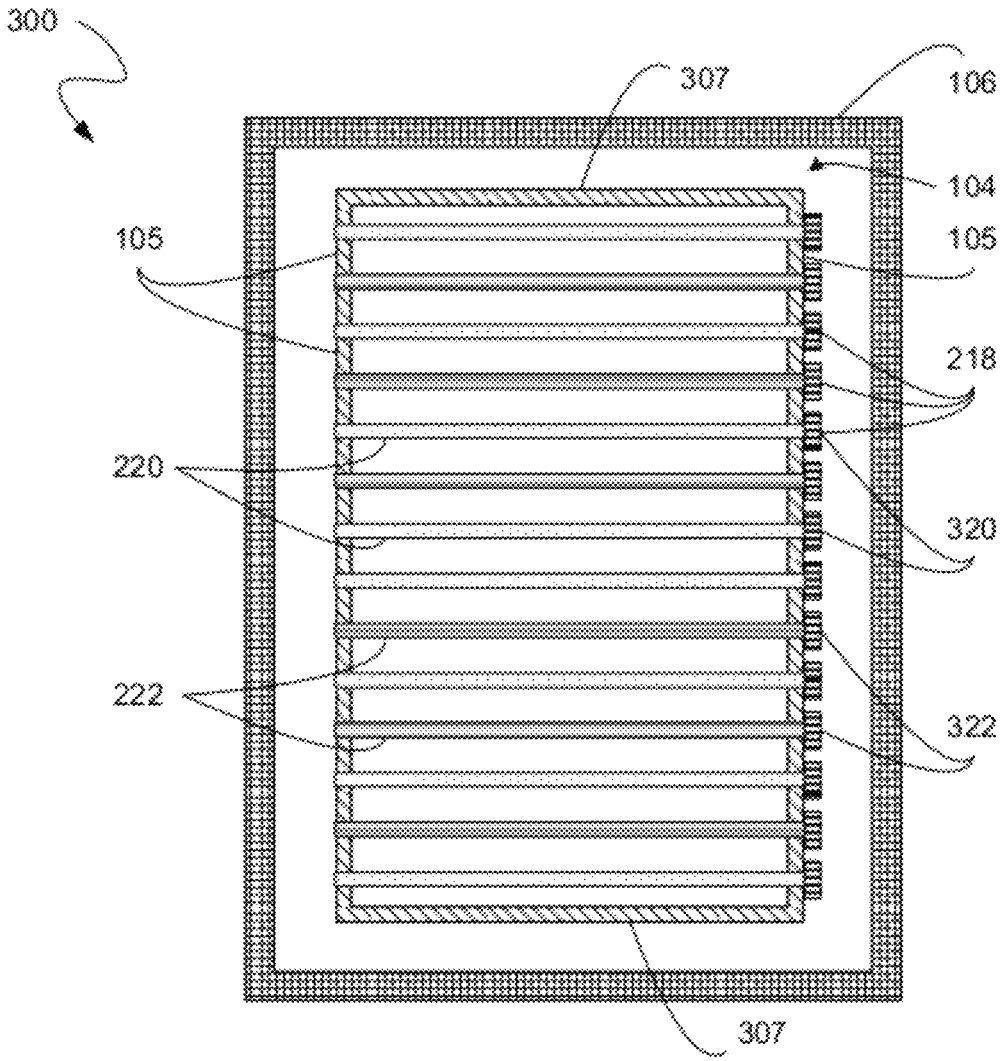
FIG. 3 is a plan view of the plating apparatus, according to an embodiment of the present invention.

FIG. 3 is a plan view of the plating apparatus 300, according to an embodiment of the present invention. In some embodiments, there may be multiple rows of multiple substrate mounting rods. For example, there may be any number of the lower substrate mounting rods 220. The lower substrate mounting rods 220 may be coupled with lower gears 320 that are positioned in the same lower plane as the lower substrate mounting rods 220.

Similarly, there may be any number of the upper substrate mounting rods 222. The upper substrate mounting rods 222 may be coupled with upper gears 322 that are positioned in the same upper plane as the upper substrate mounting rods 222. In this way, more substrates can be exposed to the plating fluid 109 (FIG. 1), thus increasing production output.

In addition, the rows of substrate mounting rods may be offset from the other rows of substrate mounting rods such that no substrate mounting rod is directly below or beneath another substrate mounting rod. For example, the lower substrate mounting rods 220 and the upper substrate mounting rods 222 may be offset from each other. As a result, the lower substrate mounting rods 220 are positioned between the upper substrate mounting rods 222. In this way, the laminar flow pattern 114 (FIG. 1) of the plating fluid 115 (FIG. 1) that passes between the lower substrate mounting rods 220 will be minimally disrupted when it reaches the upper substrate mounting rods 222. Accordingly, substrates mounted on substrate mounting rods of all rows may be exposed to a uniform laminar flow of the plating fluid 115 (FIG. 1).

In various embodiments, the rack 104 may include front walls 307 along with the side walls 105. The top and bottom of the rack 104 remain open, allowing the plating fluid 115 (FIG. 1) to flow from the bottom of the rack 104 to the top of the rack 104. In some embodiments, the rack 104 may include the side walls 105 without the front walls 307.

The gears 218 may be coupled with the lower substrate mounting rods 220 and the upper substrate mounting rods 222, and the gears 218 may be separated from the inside of the rack 104 by the side walls 105. The lower substrate mounting rods 220 and the upper substrate mounting rods 222 may extend through the side walls 105 of the rack 104 so that they may be coupled with the gears 218.

Accordingly, while the gears 218 are operable to rotate the lower substrate mounting rods 220 and the upper substrate mounting rods 222, the gears 218 are isolated from the inside of the rack 104 where the substrates 102 are positioned. As a result, any particles that are shed by the rubbing between the gears 218 or any other mechanical movement will be separated from the substrates 102 by the side walls 105 to prevent the particles from causing defects.

Figure 4:
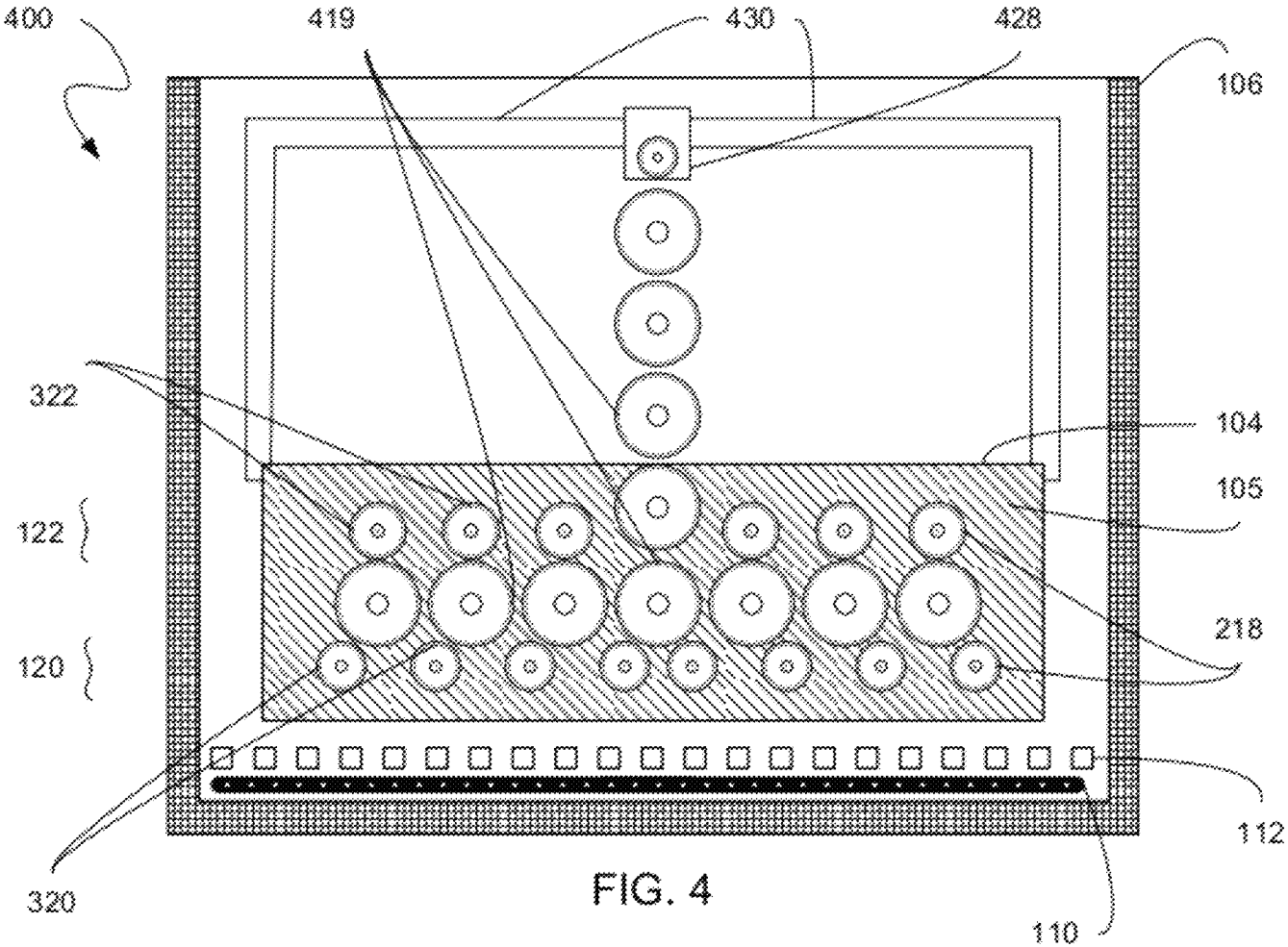
FIG. 4 is a cross section of an adjustable plating apparatus in a first position, according to an embodiment of the present invention.

FIG. 4 is a cross section of an exemplary adjustable plating apparatus 400, according to an embodiment of the present invention. The gears 218 may be positioned on the outside of the side wall 105 of the rack 104. The lower gears 320 in the lower level rows 120 are coupled to the lower level substrate mounting rods 220 (FIG. 2). Similarly, the upper gears 322 in the upper level row 122 are coupled to the upper level substrate mounting rods 222 (FIG. 2).

Rack support arms 430 may support a motor 428 above the rack 104. The lower gears 320 and upper gears 322 may be rotated by the motor 428 through a series of actuation gears 419. For example, the actuation gears 419 may be positioned in a row between the rows of lower gears 320 and upper gears 322 such that the actuation gears 419 may be coupled with the lower gears 320 and the upper gears 322, causing them to rotate. The row of the actuation gears 419 may be coupled with the motor 428 through a column of the actuation gears 419. Accordingly, the motor 428 may ultimately rotate the substrate mounting rods through the actuation gears 419, the lower gears 320, and the upper gears 322.

In various embodiments, the rack 104 may be adjustable with respect to the vessel 106. For example, the substrate mounting rods of the rack 104 may be first loaded with substrates when the rack 104 is outside the vessel 106. Subsequently, the rack 104 may be placed inside the vessel 106, and the vertical positioning of the rack 104 inside the vessel 106 may be adjusted.

Figure 5:
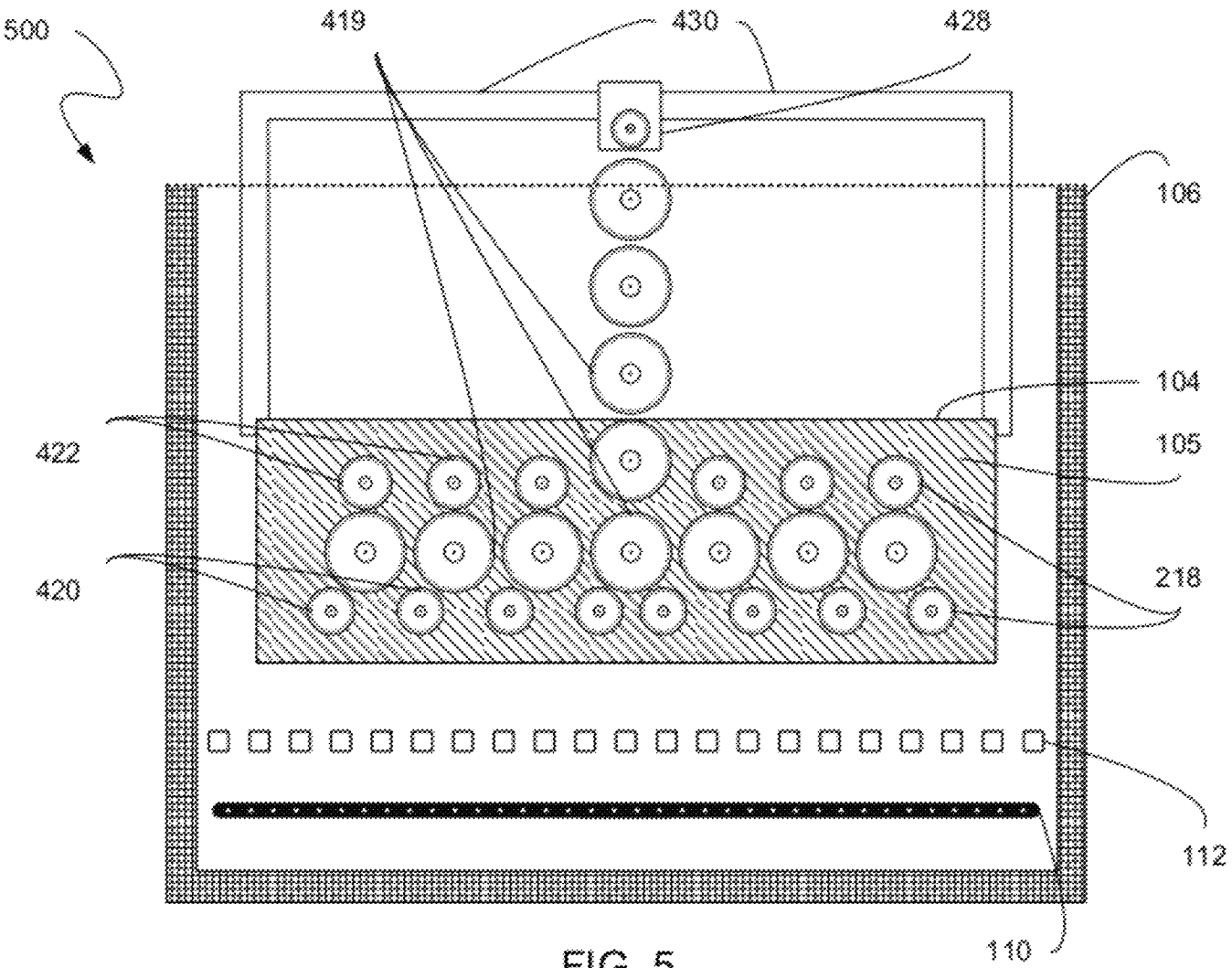
FIG. 5 is a cross section of the adjustable plating apparatus in a second position, according to an embodiment of the present invention.

FIG. 5 is a cross section of the adjustable plating apparatus 400, according to an embodiment of the present invention. The distance between the rack 104 and the bottom of the vessel 106 may be adjusted to vary the exposure of the substrates 102 (FIG. 1) to the laminar flow pattern 114 (FIG. 1) of the plating fluid 115 (FIG. 1). For example, the distance between the rack 104 and the bottom of the vessel 106 in FIG. 5 is greater than in FIG. 4.

In addition, in some embodiments, the position of the sparger 110 and the diffuser 112 may be adjusted to vary the laminar flow pattern. For example, the distances between the sparger 110, diffuser 112, rack 104, and bottom of the vessel 106 in FIG. 5 are greater than in FIG. 4.

Figure 6:
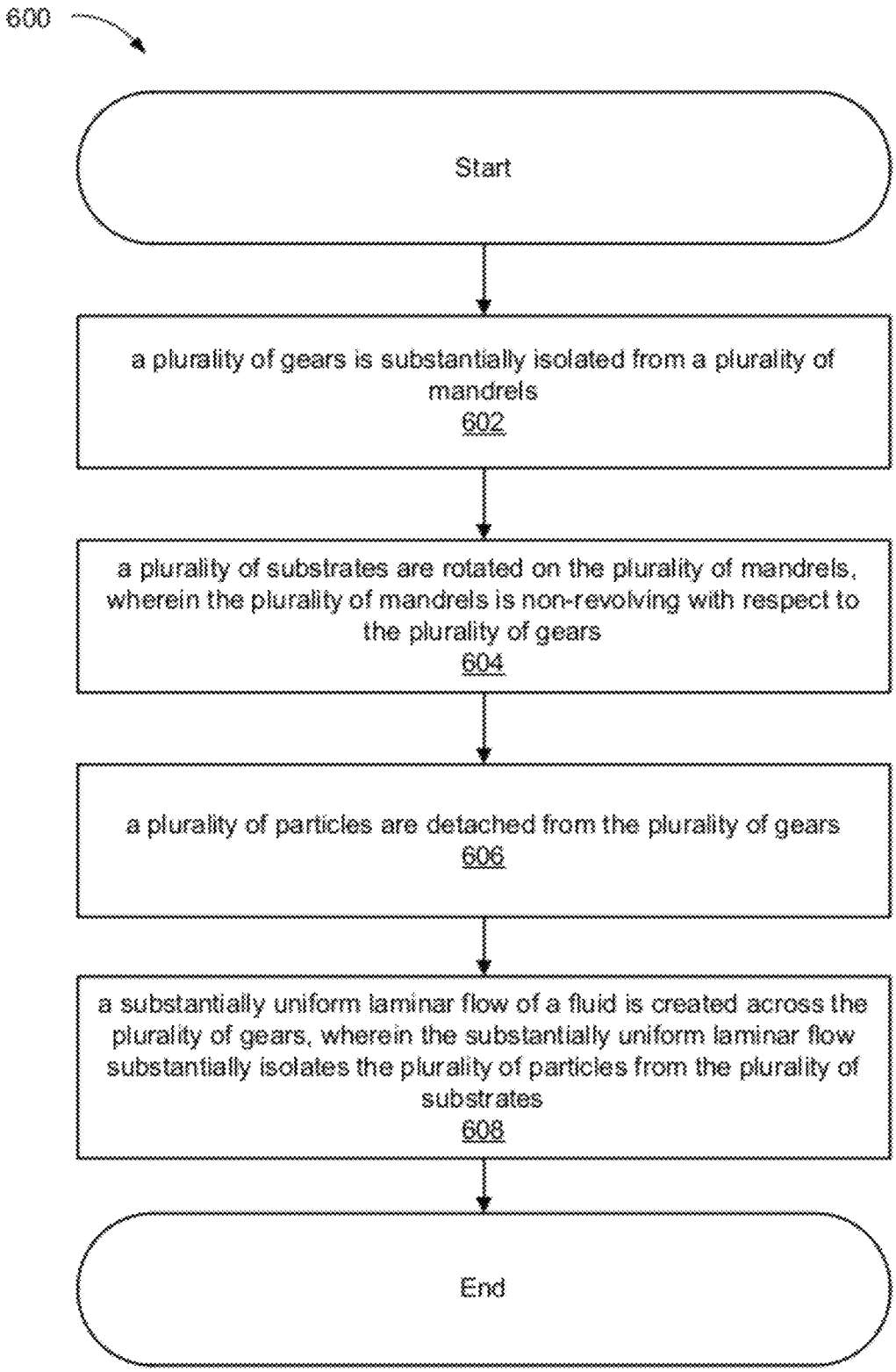
FIG. 6 depicts a flowchart of a process of plating substrates, according to an embodiment of the present invention.

FIG. 6 depicts a flowchart of an exemplary process of plating substrates, according to an embodiment of the present invention. In a block 602, a number of gears is substantially isolated from a number of mandrels. For example, in FIGS. 2 and 3 the gears 218 are substantially isolated from the mandrels 220 and 222. In an embodiment, the number of gears may be coupled with the number of mandrels, wherein a partition separates the number of gears from the number of mandrels. For example, in FIGS. 2 and 3 the gears 218 are coupled with the mandrels 220 and 222 and are separated by the side wall 105.

In a block 604 of FIG. 6, a number of substrates are rotated on the number of mandrels, wherein the number of mandrels is non-revolving with respect to the number of gears. For example, the substrates 102 in FIG. 2 are rotated in the direction depicted in FIG. 1, where the mandrels 220 and 220 in FIG. 2 are non-revolving with respect to the gears 218.

In various embodiments, non-rotational movement of the number of substrates may be limited with a number of retainers. For example, in FIG. 2 the non-rotational movement of the substrates 102 is limited by the retaining bars 224. In an embodiment, the number of mandrels is operable to be individually rotated by the number of gears. For example, in FIG. 2 the substrate mounting rods 220 and 222 are operable to be individually rotated by the gears 218.

In some various embodiments, the number of mandrels is positioned in two layers of horizontal rows. For example, in FIG. 2 the substrate mounting rods 220 and 222 are positioned in the lower level row 120 and the upper level row 122. In one embodiment, the number of mandrels is operable to be adjustable to change a distance between the number of mandrels and the diffuser. For example, in FIGS. 4 and 5 the distance of the substrate mounting rods corresponding to the gears 218 in the rack 104 may be adjusted with respect to the diffuser 110.

In some embodiments, a number of substrates within a number of workpiece mounting indentations may be secured with a number of retainers, wherein the number of retainers remains substantially free of contact with the number of substrates until at least one of the number of substrates begins to depart from at least one of the number of workpiece mounting indentations. For instance, during movement of the rack, one or more of the substrates may be shaken out of position. For example, in FIG. 2 the substrates 102 within the spacers 226 are secured by the retaining bars 224, where the retaining bars 224 remain free of contact with the substrates 102 until at least one of the substrates 102 begins to depart from the mounting indentations 227.

In a block 606 of FIG. 6, a number of particles is detached from the number of gears. For example, in FIG. 4 particles may shed as a result of the contact between gears 218. In various embodiments, a number of particles is detached from a number of retaining rods. For example, in FIG. 2 if at least one of the substrates 102 begins to depart from the mounting indentations 227, the retaining bars 224 may contact the departing substrate 102, causing particles to shed. For example, if the substrates 102 temporarily jump due to a shock event, the retaining bars 224 will stop the substrates 102, causing the substrates 102 to return their respective mounting indentations 227

In a block 608 of FIG. 6, a substantially uniform laminar flow of a fluid is created across the number of gears, wherein the substantially uniform laminar flow substantially isolates the number of particles from the number of substrates. For example, in FIG. 1 a substantially uniform laminar flow of the fluid 114 created by the sparger 110 and the diffuser 112 carries particles away from the substrates 102. In various embodiments, a diffuser is positioned below a rack, wherein the diffuser is operable to produce a substantially uniform laminar flow of a fluid from a bottom to a top of the vessel. For example, in FIG. 1 a substantially uniform laminar flow of the fluid 114 created by the diffuser 112 flows from the bottom to the top of the vessel 106.

In an embodiment, dead zones within the fluid may be substantially prevented. For example, in FIG. 1 a substantially uniform laminar flow of the fluid 114 may be created across the bottom of the vessel 106 by the sparger 110 and the diffuser 112 such that dead zones in the bath 108 are prevented.

In various embodiments, a substantially uniform flow of the fluid is produced across the number of substrates. For example, in FIG. 1 the plating fluid 109 flows across the substrates 102 in the laminar flow pattern 114. In further embodiments, gas bubbles within the fluid may be substantially separated from the number of substrates. For example, the laminar flow 114 of the plating fluid 109 carries away particles from the substrates 102.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

What is claimed is:

1. An apparatus comprising:

a plurality of gears;

a plurality of mandrels coupled with said plurality of gears, wherein each mandrel of said plurality of mandrels is coupled to a corresponding gear of said plurality of gears;

a plurality of workpiece mounting indentations on said plurality of mandrels;

a wall substantially isolating said plurality of gears from said plurality of workpiece mounting indentations, wherein said plurality of mandrels is substantially fixed in position with respect to said plurality of gears by said wall; and a diffuser positioned below said plurality of mandrels configured to direct plating fluid flow in parallel layers.

2. The apparatus of claim 1, wherein each mandrel of said plurality of mandrels is operable to be rotated by said plurality of gears.

3. The apparatus of claim 1, further comprising a plurality of retaining bars operable to maintain a plurality of workpieces within said plurality of workpiece mounting indentations and substantially free of contact with said plurality of workpieces while said plurality of workpieces are within said plurality of workpiece mounting indentations.

4. The apparatus of claim 1, wherein said plurality of mandrels are positioned in multiple layers of horizontal rows.

5. The apparatus of claim 1, wherein said diffuser is operable to substantially hinder the formation of dead zones within a fluid.

6. The apparatus of claim 1, further comprising a diffuser positioned below said plurality of mandrels, wherein said diffuser is operable to produce a substantially uniform laminar flow of a fluid across said plurality of gears and said plurality of mandrels, wherein said substantially uniform laminar flow is operable to isolate particles and gas bubbles from said plurality of gears and said plurality of mandrels.

7. The apparatus of claim 1, wherein a height of said plurality of mandrels is operable to be adjusted.

8. An apparatus comprising:

a plurality of gears;

a lower mandrel configured to mount a first plurality of workpieces in a lower row;

an upper mandrel configured to mount a second plurality of workpieces in an upper row with respect to the lower row, wherein said upper mandrel is further configured to rotate said second plurality of workpieces at a non-revolving and fixed position within said upper row;

a plurality of mandrels coupled with said plurality of gears, wherein each mandrel of said plurality of mandrels is coupled to a corresponding gear of said plurality of gears, and wherein said plurality of mandrels includes said lower mandrel and said upper mandrel;

a plurality of workpiece mounting indentations on said plurality of mandrels;

a wall substantially isolating said plurality of gears from said plurality of workpiece mounting indentations, wherein said plurality of mandrels is substantially fixed in position with respect to said plurality of gears;

a diffuser positioned between a sparger and said plurality of mandrels configured to direct plating fluid flow in parallel layers.

9. The apparatus of claim 8, wherein each mandrel of said plurality of mandrels-is operable to be rotated by said plurality of gears.

10. The apparatus of claim 8, further comprising a plurality of retaining bars operable to maintain a plurality of workpieces within said plurality of workpiece mounting indentations and substantially free of contact with said plurality of workpieces while said plurality of workpieces are within said plurality of workpiece mounting indentations.

11. The apparatus of claim 8, wherein said plurality of mandrels are positioned in multiple layers of horizontal rows.

12. The apparatus of claim 8, further comprising a diffuser positioned below said plurality of mandrels, wherein said diffuser is operable to produce a substantially uniform laminar flow of a fluid across said plurality of gears and said plurality of mandrels, wherein said substantially uniform laminar flow is operable to isolate particles and gas bubbles from said plurality of gears and said plurality of mandrels.

13. The apparatus of claim 8, wherein a height of said plurality of mandrels is operable to be adjusted.

14. An apparatus comprising:

a plurality of mandrels coupled with a plurality of gears, wherein each mandrel of said plurality of mandrels is coupled to a corresponding gear of said plurality of gears;

a plurality of workpiece mounting indentations on said plurality of mandrels configured to mount a plurality of workpieces at inner edges of the plurality of workpieces while leaving outer edges of said plurality of workpieces free of contact;

a wall substantially isolating said plurality of gears from said plurality of workpiece mounting indentations, wherein said plurality of mandrels is substantially fixed in position with respect to said plurality of gears; and a diffuser positioned between a sparger and said plurality of mandrels configured to direct plating fluid flow in parallel layers.

15. The apparatus of claim 14, wherein said plurality of mandrels is operable to be rotated by said plurality of gears.

16. The apparatus of claim 14, further comprising a plurality of retaining bars operable to maintain a plurality of workpieces within said plurality of workpiece mounting indentations and substantially free of contact with said plurality of workpieces while said plurality of workpieces are within said plurality of workpiece mounting indentations.

17. The apparatus of claim 14, wherein said plurality of mandrels are positioned in multiple layers of horizontal rows.

18. The apparatus of claim 14, further comprising a diffuser positioned below said plurality of mandrels, wherein said diffuser is operable to substantially hinder the formation of dead zones within a fluid.

19. The apparatus of claim 14, further comprising a diffuser positioned below said plurality of mandrels, wherein said diffuser is operable to produce a substantially uniform laminar flow of a fluid across said plurality of gears and said plurality of mandrels, wherein said substantially uniform laminar flow is operable to isolate particles and gas bubbles from said plurality of gears and said plurality of mandrels.

20. The apparatus of claim 14, wherein a height of said plurality of mandrels is operable to be adjusted.

* * * * *